United States Patent [19]

Westendorf et al.

[11] 4,222,442

[45] Sep. 16, 1980

[54] METHOD AND APPARATUS FOR POWER MOUNTING AN IMPLEMENT ON A TRACTOR

[76] Inventors: Neal W. Westendorf, Smithland, Iowa 51056; Joseph W. Langenfeld, Onawa, Iowa 51040

[21] Appl. No.: 969,371

[22] Filed: Dec. 14, 1978

[51] Int. Cl.[2] ..... A01B 51/00

[52] U.S. Cl. ..... 172/273; 172/804; 172/809; 172/277

[58] Field of Search ..... 172/804, 277, 272, 274, 172/805, 807, 803, 273; 37/41, 42 R, 50; 414/686

[56] References Cited

U.S. PATENT DOCUMENTS

| | | | |
|---|---|---|---|
| 1,808,139 | 6/1931 | Hozack | 172/801 |
| 2,659,572 | 11/1953 | Steer | 172/809 |
| 2,662,459 | 12/1953 | Shore | 172/274 |
| 2,875,535 | 3/1959 | Williams et al. | 172/254 |
| 3,217,431 | 11/1965 | Heinzroth | 172/277 |
| 3,279,105 | 10/1966 | Kolinger | 172/801 |
| 3,441,091 | 4/1969 | Helling | 172/801 |
| 3,509,956 | 5/1970 | Dufrense | 180/9.5 |
| 3,656,557 | 4/1972 | Eskelsen | 172/277 |
| 3,800,882 | 4/1974 | Werts et al. | 172/273 |
| 3,982,643 | 9/1976 | MacGregor | 414/686 |
| 4,051,962 | 10/1977 | Westendorf | 414/686 |

*Primary Examiner*—Richard C. Pinkham
*Assistant Examiner*—Carl Moy
*Attorney, Agent, or Firm*—Zarley, McKee, Thomte, Vorhees & Sease

[57] ABSTRACT

A method and means for power mounting and dismounting a materials handling apparatus on a tractor. The apparatus comprises a first U-shaped frame which is adapted to be connected adjacent the rearward end thereof to the tractor rearwardly of the forward end thereof. The forward end of the U-shaped frame is adapted to be secured to the tractor adjacent the forward end thereof. A second U-shaped frame is pivotally secured adjacent its rearward end to the first frame and has a third frame pivotally secured to the forward end thereof. In one embodiment, a dozer blade is pivotally secured about a horizontal axis to the third frame. Power cylinders are provided for: (1) raising and lowering the dozer blade; (2) angling the dozer blade in two directions; and (3) raising one end of the dozer blade with respect to the other end. The method of mounting the apparatus on the tractor comprises the steps of: (1) driving the tractor adjacent the first frame so that the forward end of the tractor is disposed forwardly of the rearward end of the first frame; (2) actuating a power cylinder to pivotally move the forward end of the first frame upwardly relative to the second frame and to the tractor; (3) driving the tractor forwardly to effect a connection between the forward end of the tractor and the forward end of the first frame; and (4) actuating the power cylinder to raise the rearward end of the first frame for connection to the tractor.

12 Claims, 14 Drawing Figures

METHOD AND APPARATUS FOR POWER MOUNTING AN IMPLEMENT ON A TRACTOR

BACKGROUND OF THE INVENTION

This invention relates to a method and means for mounting a materials handling apparatus such as a dozer blade on an extremely large tractor.

Many types of devices have been previously devised for mounting materials handling apparatus such as loaders or the like on tractors. One such example is U.S. Pat. No. 3,324,954 which has met with considerable success. The advent of tremendously large tractors such as the Versatile 800 and the Steiger Cougar make it desirable to provide an improved method and means for mounting materials handling equipment such as dozer blades or the like thereon.

In designing an apparatus for mounting a dozer blade or the like on an extremely large tractor, several factors must be considered. The main factor to be considered is the strength of the mounting structure and the actual mounting of the structure on the tractor. It is highly undesirable to drill holes or the like in the tractor frames for mounting equipment thereon. A second factor to be considered is the ease of attaching and removing the apparatus. If the apparatus is difficult to mount on the tractor, the apparatus will meet with little success since it is desirable to be able to quickly remove the apparatus from the tractor to enable the tractor to be used for other tasks.

Therefore, it is a principal object of the invention to provide an improved method and means for mounting a materials handling apparatus on a tractor.

A further object of the invention is to provide an improved method and means for mounting a dozer blade apparatus on a tractor.

A still further object of the invention is to provide a means for mounting a materials handling apparatus on a tractor which does not require that objectionable holes be drilled in the tractor frame.

A still further object of the invention is to provide a method and means for quickly power mounting a materials handling apparatus on a tractor.

A still further object of the invention is to provide a method and means for mounting a dozer blade apparatus on a tractor which is durable.

A still further object of the invention is to provide a means for mounting a dozer blade apparatus on a tractor wherein high ground clearance is provided when the apparatus is mounted on the tractor.

A still further object of the invention is to provide a means for mounting a dozer blade apparatus on a tractor which transmits stress forces imposed on the blade to the axle of the tractor.

A still further object of the invention is to provide a means for mounting a dozer blade apparatus on a tractor which includes a grille guard.

These and other objects will be apparent to those skilled in the art.

DESCRIPTION OF THE PREFERRED EMBODIMENT

Figures 1, 2, 3, 4:
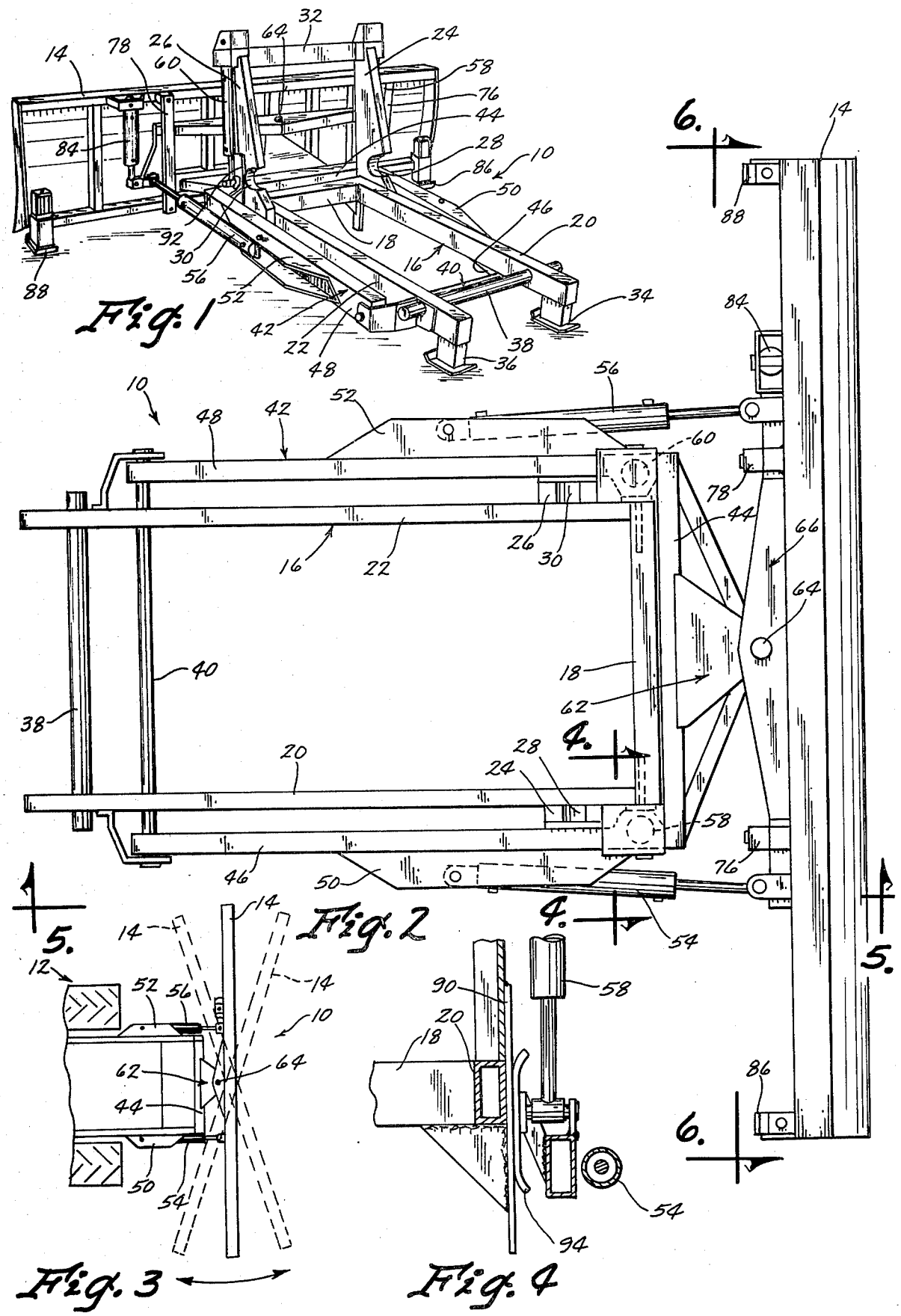
FIG. 1 is a rear perspective view of the dozer blade apparatus.
FIG. 2 is a top view of the dozer blade apparatus.
FIG. 3 is a partial top view of the dozer blade mounted on a tractor with the broken lines illustrating the pivotal movement of the blade.
FIG. 4 is an enlarged sectional view taken on lines 4—4 of FIG. 2.

The numeral 10 refers generally to the dozer blade apparatus of this invention while the numeral 12 refers to a tractor of the type previously described. While the drawings illustrate that the apparatus 10 includes a dozer blade 14, it should be understood that the blade 14 may be removed from the apparatus and other materials handling equipment mounted thereon such as buckets, fertilizer tanks, etc. However, it should be noted that the preferred embodiment is that illustrated in the drawings.

Apparatus 10 generally comprises a U-shaped frame means 16 comprising a front frame member 18 having side frame members 20 and 22 secured to the opposite ends thereof and extending rearwardly therefrom. Upstanding supports or stanchions 24 and 26 are secured to the forward ends of side frame members 20 and 22. Stanchions 24 and 26 are provided with rearwardly presented semi-circular openings 28 and 30 formed therein adjacent the lower rearward ends thereof. Brace 32 is secured to and extends between the upper ends of stanchions 24 and 26 as illustrated in the drawings. It is preferred that a grille guard apparatus be provided between stanchions 24 and 26 to protect the grille of the tractor. The grille guard has been omitted from the drawings to facilitate illustration of related structure.

The rearward ends of side frame members 20 and 22 are provided with downwardly extending supports or feet 34 and 36 which are adapted for ground engagement. Shaft 38 is secured to and extends between the rearward ends of side frame members 20 and 22 and has its opposite ends positioned outwardly of side frame members 20 and 22 as illustrated in the drawings. Pipe 40 is secured to and extends between side frame members 20 and 22 forwardly of shaft 38 and also has its opposite ends positioned outwardly of the side frame members 20 and 22.

The numeral 42 refers generally to a second U-shaped frame means generally comprising a front frame member 44 having side frame members 46 and 48 secured to opposite ends thereof and extending rearwardly therefrom. As seen in the drawings, the rearward ends of side frame members 46 and 48 are pivotally mounted on the outer ends of pipe 40. Side frame members 46 and 48 are provided with cylinder support channels 50 and 52 extending outwardly therefrom. The rearward or base ends of hydraulic cylinders 54 and 56 are pivotally secured to the channels 50 and 52 respectively.

The upper or base ends of cylinders 58 and 60 are pivotally secured to the upper ends of stanchions 24 and 26 respectively and extend downwardly therefrom as seen in the drawings. The lower ends of the cylinder rods of the cylinders 58 and 60 are pivotally secured to side frame members 46 and 48 respectively for raising and lowering the forward end of frame means 42 relative to frame means 16.

Support 62 is secured to and extends forwardly from the center portion of front frame member 44 and has a vertically disposed pipe portion or pivot pin 64 mounted therein. Frame means 66 is mounted on the upper and lower ends of pipe portion 64 for pivotal movement with respect thereto. Frame means 66 includes upper and lower frame members 68 and 70 having end frame members 72 and 74 secured to the opposite ends thereof and extending therebetween.

Figure 7:
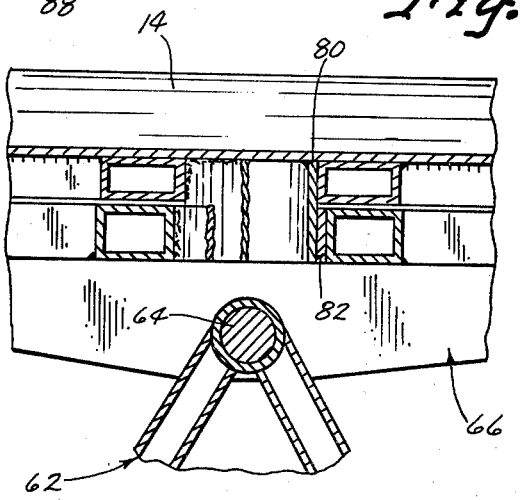
FIG. 7 is an enlarged sectional view taken on lines 7—7 of FIG. 6.
Figure 8:
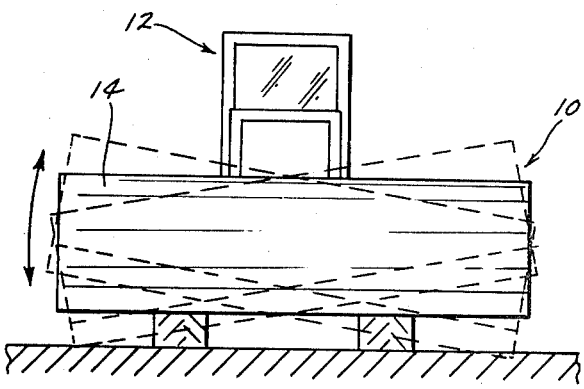
FIG. 8 is a front view of the dozer blade mounted on a tractor with the broken lines illustrating the tilting movements of the blade.

Dozer blade 14 includes spaced apart posts 76 and 78 positioned at the rearward side thereof and which are spaced rearwardly with respect thereto. The posts 76 and 78 are bolted to the dozer blade 14 at the upper and lower ends thereof. The opposite ends of frame means 66 is received between the posts 76 and 78 and the dozer blade as illustrated in the drawings. As seen in FIG. 7, dozer blade 14 has a rearwardly extending pipe portion 80 which is rotatably embraced by pipe portion 82 secured to frame means 66 to provide a pivotal connection, about a horizontal axis, between frame means 66 and the dozer blade 14. The forward or rod ends of hydraulic cylinders 54 and 56 are pivotally connected to the lower outer ends of frame means 66 as seen in the drawings. Hydraulic cylinder 84 is pivotally connected as upper end to the upper rearward end of dozer blade 14 and has its lower rod end pivotally connected to one end of frame means 66 adjacent the point of connection between hydraulic cylinder 56 and frame means 66. As illustrated in the drawings, dozer blade 14 is provided with downwardly extending and threadably adjustable shoe devices 86 and 88 which serve as fine adjustments to limit the penetration of the blade into the ground.

Rub bars 90 and 92 are secured to the forward ends of side frame members 20 and 22 and extend downwardly therefrom. Rub bars 94 and 96 (not shown) are secured to the inner forward ends of side frame members 46 and 48 and extend upwardly therefrom for sliding engagement with the rub bars 90 and 92 to prevent damaging twisting movement between the frame means 42 and frame means 16 should one corner of the dozer blade strike an obstruction or the like.

A front mounting assembly 98 is secured to the forward end of the tractor generally comprises a front portion 100 having side portions 102 and 104 extending rearwardly from the rearward ends thereof. The rearward ends of sideportions 102 and 104 are clamped onto the side frames of the tractor by means of a bar 106 positioned at the inside surface of the side frame of the tractor and having bolts extending through the upper and lower ends thereof which are received by the upper rearward and upper lower ends of the side portion 104. Other suitable mounting bolts may be extended through the side portions 102 and 104 and received by openings provided in the side frame of the tractor. Side portions 102 and 104 are provided with outwardly extending shaft stubs 108 and 110 which are adapted to be received by the openings 28 and 30 in stanchions 24 and 26 respectively.

Figure 12:
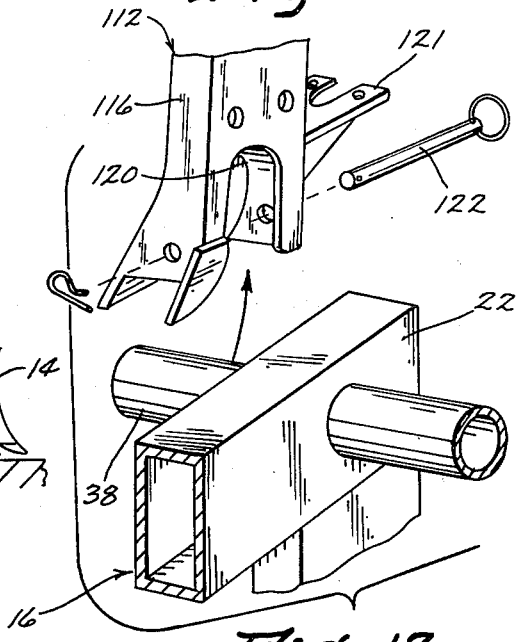
FIG. 12 is a partial perspective view of the means for mounting the rearward end of one side of the dozer blade to the tractor.
Figure 13:
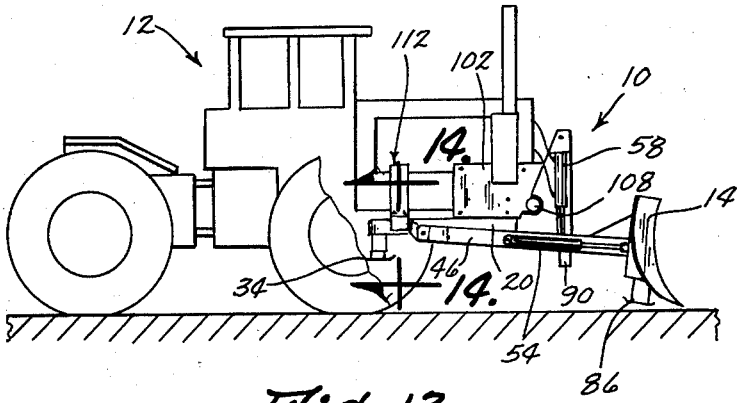
FIG. 13 is a view similar to FIGS. 9 and 11 illustrating a further step in the mounting sequence.
Figure 14:
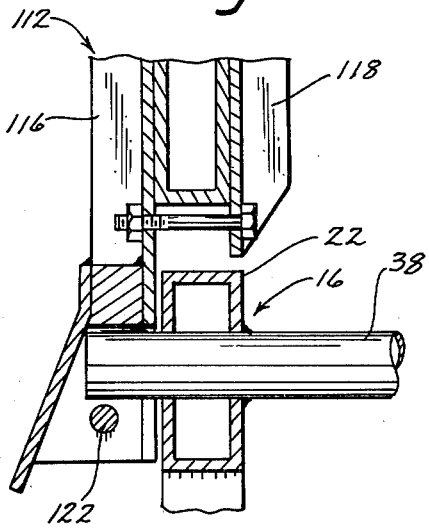
FIG. 14 is an enlarged sectional view taken on lines 14—14 of FIG. 13.

Rear mounts 112 and 114 are secured at each side of the tractor frame rearwardly of the forward end thereof. Each of the rear mounts 112 and 114 comprises a vertically disposed outer bar 116 having an inner bar 118 positioned at the inside surface of the tractor frame and bolted to the upper and lower ends of the bar 116 by bolts. The lower ends of outer bars 116 are provided with downwardly presented openings 120 which are adapted to receive the opposite ends of shaft 38. Bolt 122 is adapted to be extended through the lower end of the outer bar 116 to maintain the shaft 38 in the opening 120 as seen in FIG. 12. Outer bar 116 is also secured to the tractor axle by bracket 121 which extends rearwardly therefrom to transmit shock imposed on the apparatus to the tractor axle rather than the tractor frame.

All of the hydraulic cylinders disclosed herein are adapted to have quick couplers provided thereon to enable the hydraulic cylinders to be quickly and easily connected to the tractor hydraulic system or to a hydraulic pump operated by the tractor engine.

Figure 5:
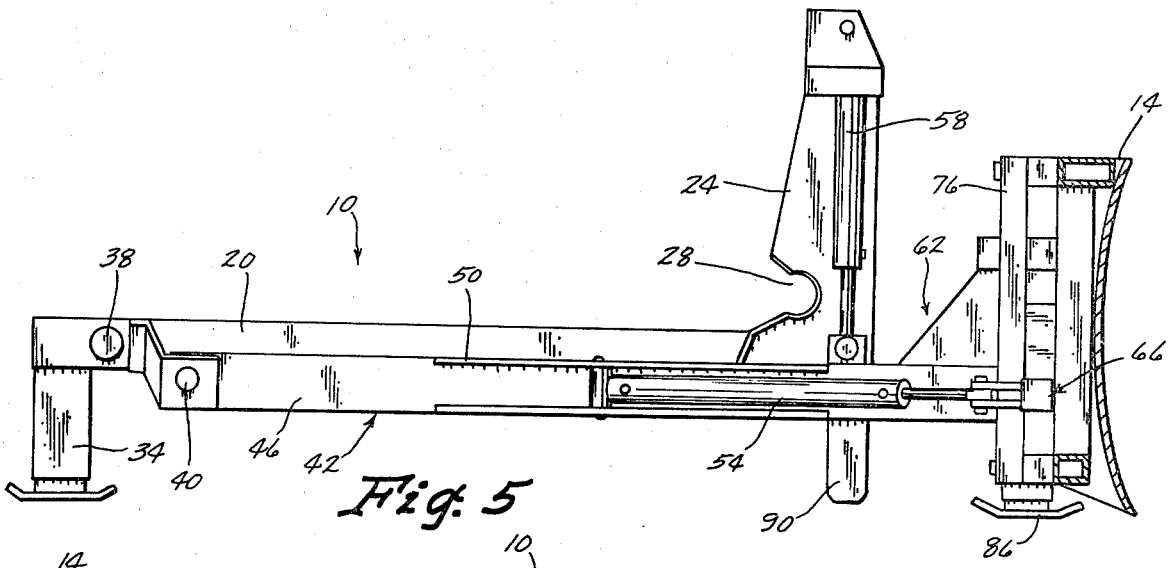
FIG. 5 is a sectional view taken on lines 5—5 of FIG. 3.
Figure 6:
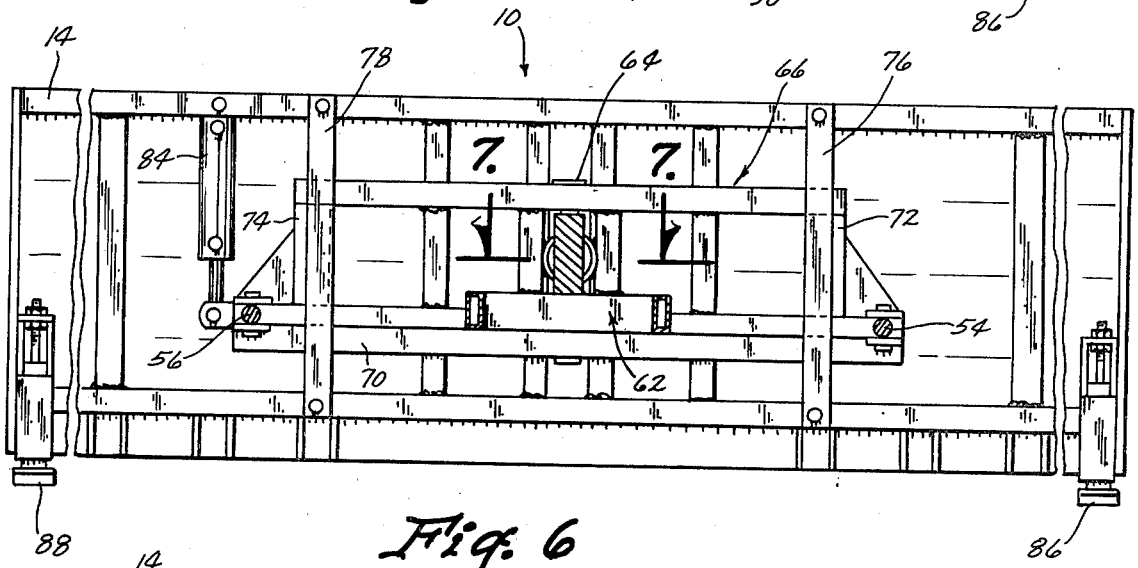
FIG. 6 is a sectional view taken on lines 6—6 of FIG. 2.
Figure 9:
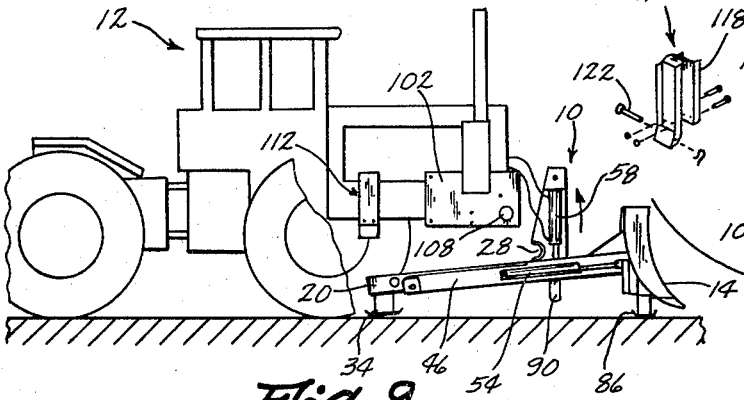
FIG. 9 is a partial side view illustrating the dozer blade being mounted on a tractor.
Figure 10:
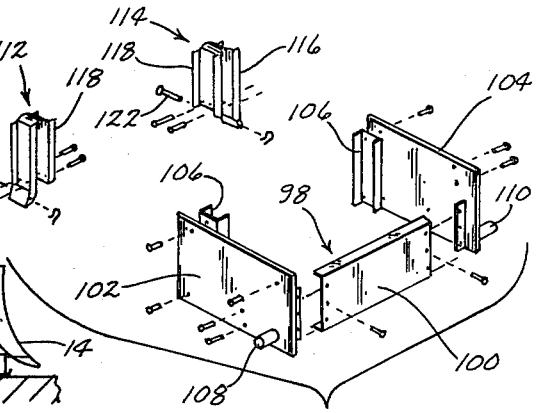
FIG. 10 is an exploded perspective view of the mounting brackets which are secured to the tractor frame and axle.
Figure 11:
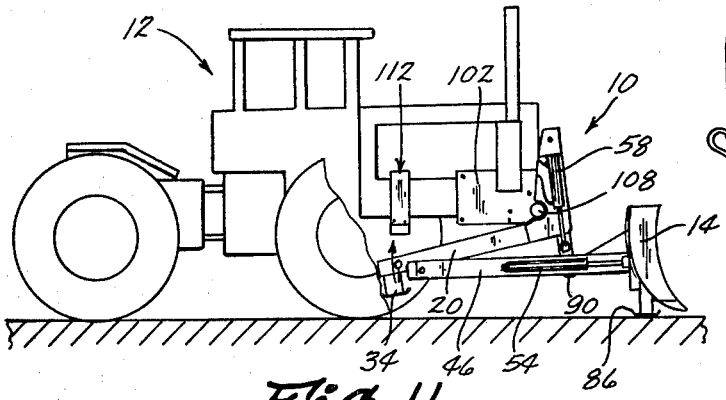
FIG. 11 is a view similar to FIG. 9 illustrating a further step in the mounting sequence.

Assuming that the apparatus 10 is positioned on the ground and detached from the tractor, as seen in FIGS. 1, 5 and 9, the normal method of mounting the same is as follows. The tractor 12 is driven forwardly with respect to the apparatus 10 as seen in FIG. 9 so that the rearward end of fhe frame means 16 is positioned rearwardly of the forward end of the tractor and so that the shaft stubs 108 and 110 are positioned adjacent the rearward ends of the stanchions 24 and 26. The hydraulic cylinders 58 and 60 are then operatively connected to the source of hydraulic power which is then actuated to cause the cylinders 58 and 60 to be extended so that the forward end of frame means 16 pivotally move upwardly with respect to the ground and with respect to the frame means 42. The cylinders 58 and 60 are actuated until the openings 28 and 30 in stanchions 24 and 26 are positioned forwardly of shaft stubs 108 and 110. The tractor is then driven forwardly with respect to the apparatus 10 so that shaft stubs 108 and 110 are pivotally received by the openings 28 and 30 as seen in FIG. 11. The hydraulic cylinders 58 and 60 are then retracted which causes the rearward end of frame means 16 to be pivotally moved upwardly with respect to the tractor since the frame means 16 is pivoting about the stubs 108 and 110. The cylinders 58 and 60 are retracted until the outer ends of the shaft 38 are received by the openings 120 in outer bars 116 of the rear mounts 112 and 114. Bolts 122 are then positioned in the lower ends of the outer bars 116 to maintain the rearward end of the frame means 16 in the rear mounts. The remaining hydraulic cylinders are then connected to the source of hydraulic power if the connection was not made at the time of originally connecting the cylinders 58 and 60 to the power system.

Thus, with the apparatus mounted on the tractor, the operation of hydraulic cylinders 58 and 60 causes the frame means 42 and the dozer blade to be raised and lowered with respect to the tractor. Operation of hydraulic cylinder 54 causes one end of the dozer blade 14 to be moved forwardly or rearwardly with respect to the frame means 42 due to the pivotal connection of the frame means 66 with respect to the frame means 42 about pin 64. Actuation of hydraulic cylinder 56 likewise causes the other end of the dozer blade 14 to be moved forwardly or rearwardly with respect to the tractor or second frame means 42. Hydraulic cylinders 54 and 56 are of the double acting type but operate in connection with each other so that when one cylinder extends, the other cylinder closes and vice versa.

Actuation of hydraulic cylinder 84 causes the pivotal movement of dozer blade 14 about the pipe portion 82 so that one end of the dozer blade is raised or lowered with respect to the tractor with the other end of the dozer blade being conversely raised and lowered. Thus, the hydraulic cylinders included on the apparatus permit the dozer blade to be raised and lowered, angled in either direction and tilted in either direction.

The apparatus is removed from the tractor by first lowering the dozer blade into ground engagement. Bolts 122 are then removed from the rear mounts 112 and 114 with the hydraulic cylinders 58 and 60 being extended which causes the rearward end of the frame means 16 to be lowered downwardly into ground engagement. The tractor is then moved rearwardly with respect to the apparatus so that shaft stubs 108 and 110 move out of engagement with the openings 28 and 30 in the stanchions 24 and 26. Hydraulic cylinders 58 and 60 are then retracted so that the forward end of frame means 16 is lowered downwardly relative to the tractor. If desired, it is not necessary to lower the forward end of the frame means 16 after the shaft stubs 108 and 110 have been removed from the stanchions 24 and 26. Once the apparatus has been removed from the tractor, it is desirable to lower the frame means 16 relative to the frame means 42 so that the cylinder rods of cylinders 58 and 60 are not unduly exposed to the elements. The hydraulic hoses are then disconnected and the tractor may be backed rearwardly from the apparatus and used for other purposes.

It can be seen that the tractor, with the apparatus removed therefrom, may perform other functions since the front and rear mounts do not interfere with normal tractor operations. It can also be seen that the front and rear mounts are mounted on the tractor without modification of the tractor and without the necessity of drilling holes or the like in the tractor frame. The front and rear mounts are also adjustably mounted on the frame which permits the mounts to be used on a variety of different tractors.

The construction of the apparatus is such that high ground clearance is provided when the apparatus is mounted on the tractor.

Thus it can be seen that the apparatus accomplishes at least all of its stated objectives.

We claim:

1. In combination with a tractor including front and rear axles and a frame having oppositely disposed lateral protrusions adjacent the forward end thereof, a first U-shaped frame means having rearward and forward ends including a front frame member having a pair of side frame members secured to the opposite ends thereof and extending rearwardly therefrom;

first means adjacent the rearward ends of said side frame member for connection to the tractor rearwardly of the forward end thereof, second means adjacent the forward end of said first frame means for connection to the tractor adjacent the forward end thereof, said second means including a pair of rearwardly opening slots adapted to receive said tractor frame protrusions therein, said protrusions being releasably retained in said slots against rearward movement therefrom by the connection of said side frame members to said tractor by said first means, a second U-shaped frame means having rearward and forward ends including a front frame portion having a pair of side frame portions secured to the opposite ends thereof and extending rearwardly therefrom, said front frame portion of said second U-shaped frame means being positioned forwardly of said front frame member of said first frame means, said side frame portions of said second U-shaped frame means being positioned laterally of said side frame members of said first U-shaped frame means, the rearward ends of said side frame portions being pivotally secured, about a horizontal axis, to said side frame members, first power cylinder means secured to and extending between said first and second frame means for pivotally moving the forward end of said second frame means upwardly and downwardly with respect to said first frame means, a third frame means pivotally secured, about a vertical axis, to the forward end of said second frame means, second power cylinder means secured to and extending between said second and third frame means for pivotally moving said third frame means with respect to said second frame means, a materials handling apparatus pivotally secured, about a horizontal axis, to said third frame means, third power cylinder means secured to and extending between said materials handling apparatus and said third frame means for pivotally moving said materials handling apparatus with respect to said third frame means.

2. The combination of claim 1 wherein said first means comprises oppositely disposed lateral protrusions at the rearward ends of said side frame members and a clamp assembly adapted to be clamped onto said tractor frame rearwardly of each tractor frame protrusion, said clamp assembly including a downwardly presented opening in the lower end thereof adapted to receive a respective side frame member protrusion, and means associated with the lower end of said clamp assembly for releasably retaining said side frame member protrusion within said downwardly presented opening.

3. The combination of claim 2 wherein said clamp assembly includes a rearwardly extended bracket adapted for securement to the tractor front axle thereby to transmit rearwardly directed longitudinal forces to said tractor front axle.

4. In combination, a tractor having rearward and forward ends and a source of hydraulic power, a pair of cylindrical members secured to and extending horizontally outwardly from opposite sides of the tractor adjacent the forward end thereof, a pair of laterally spaced mounting means secured to said tractor rearwardly of said cylindrical members, a first generally U-shaped and horizontally disposed frame means having rearward and forward ends comprising a laterally extending front frame member having side frame members secured to the opposite ends thereof and extending rearwardly therefrom, first and second uprights secured to said first frame means adjacent the forward and thereof, each of said uprights having a rearwardly presented opening for removably receiving one of said cylindrical members, said side frame members being operatively detachably secured to said mounting means, a second generally U-shaped and horizontally disposed frame means having rearward and forward ends comprising a laterally extending front portion having side portions secured to opposite ends thereof and extending rearwardly therefrom, the rearward ends of said side portions being pivotally secured to said side frame members rearwardly of the forward ends thereof, a first hydraulic cylinder means operatively connected to said first and second frame means for raising and lowering said second frame means with respect to said first frame means, and a materials handling means operatively secured to said second frame means.

5. The combination of claim 4 wherein first and second rub bars are secured to the outer forward ends of said side frame members and extend downwardly therefrom, said side portions of said second frame means having third and fourth rub bars secured thereto which slidably engage said first and second rub bars respectively to prevent objectionable twisting movement of said second frame means with respect to said first frame means.

6. The combination of claim 1 wherein said laterally spaced mounting means include a bracket adapted for securement to the tractor front axle thereby to transmit longitudinal forces thereto.

7. The combination of claim 4, wherein a substantially vertically disposed third frame means is pivotally secured, about a vertical axis, to the forward end of said second frame means, said materials handling means comprising a dozer blade operatively secured to said third frame means, and a second hydraulic cylinder means operatively secured to and extending between said second frame means and said dozer blade for pivotally moving said dozer blade relative to said second frame means.

8. The combination of claim 7 wherein said second hydraulic cylinder is secured to said second frame means and said third frame means.

9. The combination of claim 8 wherein said dozer blade is pivotally secured, about a horizontal axis, to said third frame means, and a third hydraulic cylinder means secured to and extending between said dozer blade and said third frame means for pivotally moving said dozer blade relative to said third frame means.

10. The combination of claim 9 wherein said first hydraulic cylinder means comprises first and second hydraulic cylinders having upper and lower ends and being secured at their upper ends to said uprights and secured at their lower ends to said second frame means.

11. The combination of claim 10 wherein said second hydraulic cylinder means comprises third and fourth hydraulic cylinders secured to said side portions and opposite ends of said third frame means.

12. The method of mounting a materials handling support means on a tractor, said support means being initially detached from the tractor and including a first generally U-shaped frame means including a front frame member and rearwardly extended side frame members, said first frame means being substantially horizontally disposed and ground supported adapted to be detachably secured to a tractor and a second generally U-shaped frame means including a front frame member positioned forwardly of the front frame member of said first frame means and rearwardly extended side frame members positioned laterally outwardly of said side frame members of said first frame means, said side frame members of said first and second frame means being operatively pivotally connected together adjacent the rearward ends thereof, a power cylinder means pivotally secured to and extending between said first and second frame means for pivotally moving said first frame means with respect to said second frame means, comprising the following steps:

driving the tractor adjacent the support means so that the forward end of the tractor is positioned forwardly of the rearward end of said first frame means and so that the forward end of the tractor is positioned adjacent the forward end of said first frame means, fluidly connecting the power cylinder means to a source of power on the tractor, operating the power cylinder means to pivot said forward end of said first frame means upwardly with respect to said second frame means, pivotally mounting said first frame means, adjacent the forward end thereof, to said tractor, operating the power cylinder means to pivotally move said first frame means relative to the tractor so that the rearward end of said first frame means moves upwardly towards the tractor, and connecting said first frame means, adjacent the rearward end thereof, to the tractor.

* * * * *